US007024831B1

(12) United States Patent
Clark et al.

(10) Patent No.: US 7,024,831 B1
(45) Date of Patent: Apr. 11, 2006

(54) CONCRETE FLOOR SYSTEM AND METHOD OF MAKING FLOOR COMPONENTS

(76) Inventors: Ryan Clark, 10443 Brookhollow Cir., Highlands Ranch, CO (US) 80126; Lawrence J. Hug, 11304 Canary La., Parker, CO (US) 80138; Michael J. Martinez, 2587 S. Vrain Ct., Denver, CO (US) 80219

( * ) Notice: Subject to any disclaimer, the term of this patent is extended or adjusted under 35 U.S.C. 154(b) by 309 days.

(21) Appl. No.: 10/261,903

(22) Filed: Oct. 1, 2002

(51) Int. Cl.
*E04C 5/08* (2006.01)

(52) U.S. Cl. ..... 52/223.7; 52/263; 52/379; 52/762; 249/19; 249/25; 249/28; 264/35; 264/261

(58) Field of Classification Search ..... 52/223.7, 52/263, 762, 764, 228, 611, 608, 378, 379; 249/19, 25, 28; 264/35, 261, 334
See application file for complete search history.

(56) References Cited

U.S. PATENT DOCUMENTS 2,644,497 A * 7/1953 Wilmer et al. ..... 52/223.7
3,855,375 A * 12/1974 Boux ..... 264/35
4,694,629 A * 9/1987 Azimi ..... 52/611

* cited by examiner

*Primary Examiner*—Carl D. Friedman
*Assistant Examiner*—Yvonne M. Horton
(74) *Attorney, Agent, or Firm*—Edwin H. Crabtree; Ramon L. Pizarro

(57) ABSTRACT

A concrete floor system used in a building structure and a method of making floor components used with the floor system. The concrete floor system, if installed on grade, provides for expansion and contraction due to expansive soils and eliminates cracks, which heretofore occurred in poured concrete slab floors. The concrete floor system includes a plurality of parallel concrete beams. The beams can be made up of hollow concrete blocks for reduced weight and receiving a tension cable therethrough. Also, the beams can be either solid pre-cast beams, solid pre-cast, pre-tension beams or solid pre-cast, post-tension beams. Opposite ends of the cable are held on end plates inside recessed ends of each hollow beam. The ends of the beams are adapted for mounting next to the inside of the sides of a building foundation wall. The beams can be in a range of 5 to 20 feet and greater in length depending on the dimensions of the concrete floor. A top portion of the each parallel beam is adapted for receiving a plurality of angular shaped floor panels. The floor panels interlock next to the top portion of the beam. The floor panels and concrete blocks, used in making up one of the embodiments of the concrete tension beams, are readily adapted for making in a standard high production concrete block machine.

12 Claims, 4 Drawing Sheets

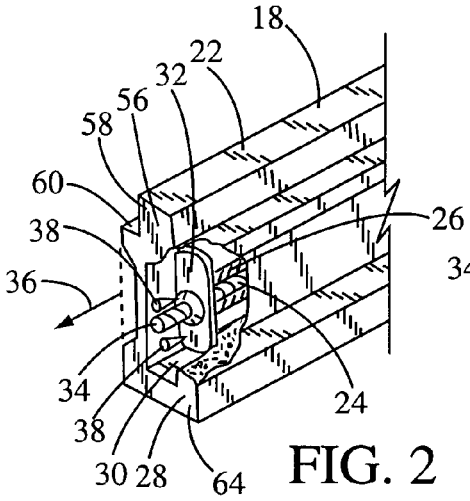
FIG. 2
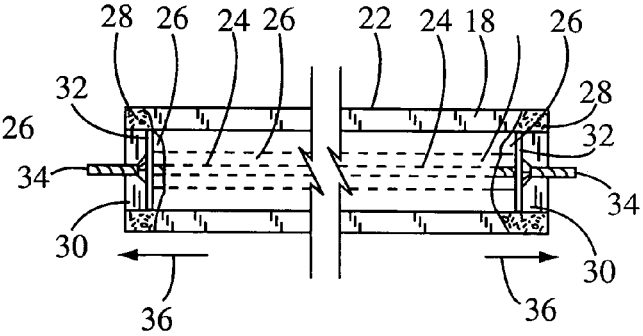
FIG. 3
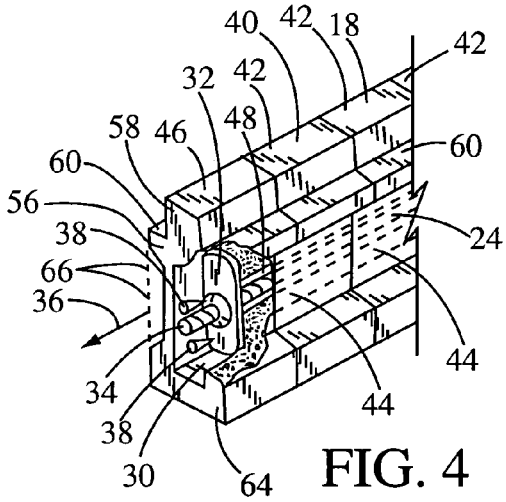
FIG. 4
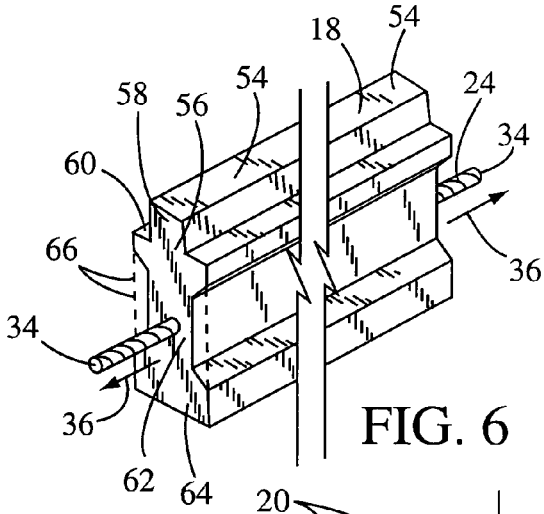
FIG. 6
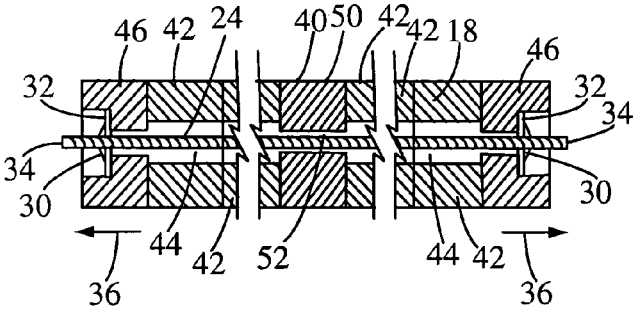
FIG. 5
FIG. 7
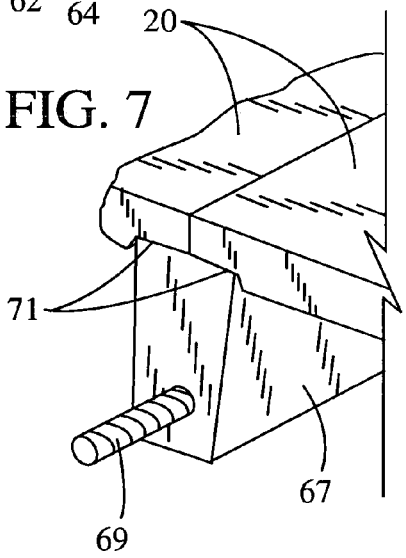

CONCRETE FLOOR SYSTEM AND METHOD OF MAKING FLOOR COMPONENTS

BACKGROUND OF THE INVENTION (a) Field of the Invention

This invention relates to a concrete floor system and method of making components used in the floor system and more particularly, but not by way of limitation, to a floor system having a plurality of pre-cast beams, or pre-tension beams or post-tension concrete beams used for receiving a plurality of interlocking concrete floor panels. The concrete floor system eliminates the use of building concrete forms, eliminates the pouring of a concrete floor in place and eliminates cracks commonly found when a concrete slab floor is poured on grade and due to the expansion and contraction of expandable soils under the concrete slab.

(b) Discussion of Prior Art

In U.S. Pat. No. 2,644,497 to Wilmer et al. and U.S. Pat. No. 3,283,457 to Hart, a clamp with rod is illustrated for holding a plurality of concrete blocks together and a method of forming a pre-stressed concrete plank or beam made up of a plurality of blocks. In U.S. Pat. No. 3,855,375 to Boux, a floor building system is disclosed. The building system includes concrete slabs with concrete infill along with forms for holding the slabs in place. In U.S. Pat. No. 4,694,629 to Azimi and U.S. Pat. No. 6,098,357, two different ways of modular pre-cast construction are described for joining blocks together. In U.S. Pat. No. 5,218,801 to Hereford, a roof truss and decking system is disclosed using multiple blocks placed in compression.

None of the above-mentioned prior art patents specifically disclose the unique features, combination of structure, function and advantages of the subject concrete floor system as described herein.

SUMMARY OF THE INVENTION

In view of the foregoing, it is a primary objective of the subject invention to provide a unique concrete floor system, which eliminates the use of concrete forms and pouring a concrete floor in place at the building site thereby reducing cost of labor in building the floor. The concrete floor system is easily adapted for mounting next to the inside of the sides of the building's concrete foundation walls and supported on steel or concrete lentals attached to the sides of the foundation walls.

Another object of the floor system is the floor components can be fabricated off site and delivered on site when the foundation walls are completed. Also, the floor components can be easily removed and replaced. Further, removing floor components allows access under the floor.

Yet another object of the floor system is the use of different types of concrete beams, which can be cut to a desired length. The beams can be solid pre-cast concrete beams. Also, the beams can be solid pre-cast, pre-tension beams. Further, the beams can be solid post-tension beams. Still further, the beams can be post-tension beams made of a plurality of hollow concrete blocks compressed together. The hollow beams made up of concrete blocks reduce the overall weight of each beam. The ends of solid and hollow concrete beams include recessed end plates, which allow the beams to be cut to size for custom installation. Also, interlocking concrete floor panels can be cut to size for custom installation. The use of individual concrete floor panels, when the floor system is on grade, provides for expansion and contraction due to expansive soils. This feature eliminates cracks, which heretofore occurred in poured concrete slab floors.

Still another object of the floor system is certain components of the floor system can be produced in a high production standard concrete block machine for reducing the cost of making the components.

The concrete floor system includes a plurality of parallel concrete beams. The beams can be made of a plurality of hollow concrete blocks for reduced weight and receiving a tension cable therethrough. Also, the beams can be either solid pre-cast beams, or solid pre-cast, pre-tension beams or solid post-tension beams. Opposite ends of the cable are held on end plates inside recessed ends of each beam. The ends of the beams are adapted for mounting on steel or concrete lentals attached to the sides of the foundation walls. The beams can be in a range of 5 to 20 feet and greater in length depending on the dimensions of the concrete floor. A top portion of the each parallel beam is adapted for receiving a plurality of angular shaped floor panels thereon. The floor panels and concrete blocks, used in making up one of the embodiments of the concrete beams, are readily adapted for making in a standard high production concrete block machine.

These and other objects of the present invention will become apparent to those familiar with various types of concrete floor systems and methods of making concrete components in a concrete block machine and concrete beams when reviewing the following detailed description, showing novel construction, combination, and elements as herein described, and more particularly defined by the claims, it being understood that changes in the embodiments to the herein disclosed invention are meant to be included as coming within the scope of the claims, except insofar as they can be precluded by the prior art.

BRIEF DESCRIPTION OF THE DRAWINGS

The accompanying drawings illustrate preferred embodiments of the present invention according to the best modes presently devised for the practical application of the principles thereof, and in which:

FIG. 2 is a perspective view of one end of a hollow post-tension concrete beam with a tension cable having one end attached to an end plate mounted inside a recess area in the end of the beam.

FIG. 3 is a partial side view of the hollow post-tension concrete beam shown in FIG. 2.

FIG. 4 is a perspective view of one end of a hollow post-tension concrete beam made up of a plurality of individual concrete blocks held against each other in compression by a tension cable. One end of the cable is shown attached to an end plate mounted inside a recess area of a concrete end block.

FIG. 5 is a partial side sectional view of the hollow post-tension concrete beam made up of individual concrete blocks shown in FIG. 4.

FIG. 6 is a perspective view of opposite ends of a pre-tension, pre-cast concrete beam having a tension cable therethrough.

FIG. 7 is a perspective view of one end of a pre-cast beam, which is not placed in pre-tension or post-tension. The pre-cast beam includes a rebar disposed in a lower portion of the beam and along it's length.

DESCRIPTION OF THE PREFERRED EMBODIMENTS

Figure 1:
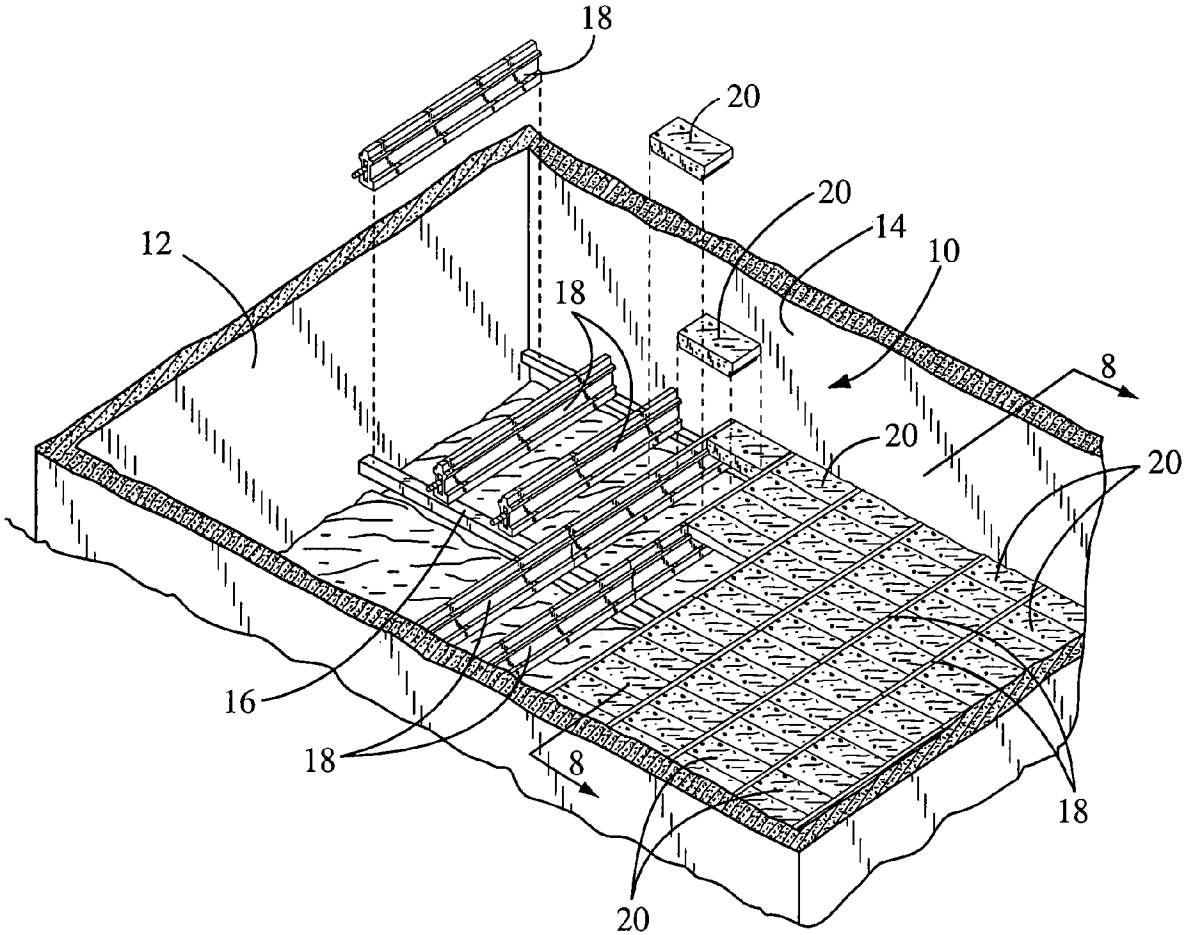
FIG. 1 is a perspective view of the subject concrete floor system being installed inside a building foundation and mounted next to the sides of foundation walls and on foundation steel or concrete beams. The floor system includes a plurality of parallel concrete beams and a plurality of angular shaped floor panels mounted on top of the concrete beams.

In FIG. 1, a perspective view of the subject concrete floor system is illustrated and having a general reference numeral 10. The floor system 10 is shown being installed inside a building foundation 12 and mounted next to the sides of foundation walls 14 and on a foundation beam 16. The foundation beam 16 can be a metal "H" or "I" beam, a concrete beam or like.

The floor system 10 broadly includes a plurality of parallel concrete beams 18 and a plurality of angular shaped concrete floor panels 20. The beams 18 can be solid pre-cast beams without tension placed thereon, solid pre-cast, pre-tension beams, solid post-tension beams, or post-tension beams made up of a plurality of hollow concrete blocks. The different embodiments of the beams 18 are shown in FIGS. 2–7. The floor panels 20 are mounted next to each other in an interlocking relationship and on top of a portion of the concrete beams 18 as shown in this drawing. Opposite sides of each floor panel 20 engage the top of adjacent beams 18. The beams 18 can vary in length from 5 to 20 feet and greater. The floor panels 20 typically have a thickness of 2 to 2½ inches, a width in a range of 7 to 8 inches and a length in a range of 23 to 24 inches. Obviously, the floor panels 20 can come in different sizes depending on the floor application. The floor system 10 can be used as a basement floor, as shown in FIG. 1, a main level floor, placed on grade or suspended above grade and used in other concrete floor applications.

In FIG. 2, a perspective view of a first embodiment of one of the concrete beams 18 is shown in the form of a solid pre-cast post-tension concrete beam 22. The post-tension beam 22 includes a tension cable 24 received through a plastic or rubber sleeve 26 along the length of the beam. Opposite ends 28 of the beam 22 include a recess area 30 for receiving an end plate 32. A portion of one of the ends 28 of the beam 22 and a portion of the plastic or rubber sleeve 26 have been cut-away in the drawing to show the recess area 30 and the internal cable 24. Both ends 28 of the beam 22 can be seen in FIG. 3. The recess area 30 shown in concrete tension beams 18 provides for the cutting off of a portion of the end of the beam for a custom fit during the assembly of the system 10.

Post-tension is applied to the cable 24, after the beam has been poured and cured, using a hydraulic cylinder attached to a cable end 34. Tension is then applied to the cable 24, as indicated by arrow 36. When sufficient tension has been applied to the cable 24 for holding loads to be placed on the beam 22, wedges 38 are inserted inside the end plate 32 to prevent the cable end 34 from slipping through the end plate 32. The hydraulic cylinder is then removed from the cable end 34. The hydraulic cylinder is not shown in the drawings.

In FIG. 3, a partial side view of the hollow post-tension concrete beam 22 is illustrated. In this drawing, the beam 22 is bowed or cambered upwardly toward the center of the length of the beam. The cambered beam 22 allows for a slight downward deflection of the beam as the top of the beam is loaded with the weight of the floor panels 20 placed thereon. Also, as the beam 22 is loaded, additional tension is placed on the cable 24, as indicated by arrows 36, and additional strength is provided to the beam.

In FIG. 4, a perspective view of another embodiment of one of the concrete beams 18 is shown in the form of a hollow post-tension concrete block beam 40. The concrete block beam 40 is made up of a plurality of hollow concrete blocks 42 compressed together by the tension cable 24 received through an opening 42, shown in dashed lines, in the blocks 42.

The beam 40 also includes end blocks 46 at opposite ends of the beam. The end blocks 46 include the recess area 30 for receiving the end plate 32. A portion of one of the end blocks 46, shown in this drawing, has been cut-away to show the recess area 30 and an opening 48 for receiving a portion of the internal cable 24 therethrough. Both of the end blocks 46 can be seen in FIG. 5.

Post-tension is applied to the cable 24, after the proper amount of concrete blocks 42 are placed side be side, using a hydraulic cylinder attached to the cable end 34. Tension is applied to the cable 24, as indicated by arrow 36, similar to the tension placed on the cable 24 shown in FIGS. 2 and 3. When sufficient tension has been applied to the cable 24 for holding loads to be placed on the beam 40, wedges 38 are inserted inside the end plate 32 to prevent the cable ends 34 from sshoulderping through the end plates 32. The hydraulic cylinder is then removed from the cable end 34.

In FIG. 5, a partial side view of the hollow post-tension concrete beam 40 is illustrated. In this drawing the beam 40, similar to beam 22, is bowed upwardly toward the center of the length of the beam. The bowed beam 40 allows for a slight downward deflection of the beam as the top of the beam is loaded with the weight of the floor panels 20 placed thereon. Also, the bowed beam 40 includes a center block 50 with a cable opening 52 therethrough for receiving a portion of the cable 24. Because of a drape along a length of the cable 24, the center block 50 helps to hold down the cable 24 as the cable compresses the blocks 42 together. The cable 24 is shown held in tension by the end plates 32, as indicated by arrows 36.

In FIG. 6, a partial perspective view of still another embodiment of one of the concrete beams 18 is shown in the form of a solid pre-cast, pre-tension concrete beam 54. The opposite ends of the pre-tension concrete beam 54 are shown in this drawing. In this example, the cable 24 is placed in tension, using a hydraulic cylinder or the like, prior to pouring concrete around the cable and forming the beam 54. The concrete beam is then allowed to cure and the tension is released on the cable 24. When the tension is released, the concrete beam is placed in compression. The beam 54 can also be slightly bowed upwardly, similar to beams 22 and 40, for compensating for live loads placed thereon.

When viewing the ends of the beams 22, 40 and 54, it should be mentioned that the beams can have an "I" beam shaped profile to help reduce weight. Also, other types of profiles can be used equally well. The beams include a top portion 56 with a crown 58 and shoulders 60 on opposite sides of the crown 58, a center portion 62, which receives the cable 24 therethrough, and a lower portion 64, which arts as base for the beam's receipt on top of the foundation beam 16. In FIGS. 2, 4 and 6, a dashed line 66 is shown to represent the center portion 62 having the same width as the lower portion 64 rather than being flared inwardly to form the "I" beam profile.

In FIG. 7, yet another embodiment of the concrete beam 18 is shown as a solid pre-cast beam 67 without pre-tension or post-tension placed thereon. In this drawing, one end of the beam 67 is shown with a rebar 69 received in a lower portion of the beams and along it's length. The rebar 69 is placed inside a concrete mold when the beam is pre-cast in the mold. In this example, the rebar 69 has a ⅞ inch diameter. The size of the rebar 69 can vary in size depending on the loads placed on the beam and it's application. The beam 67 can be cast in 20 foot lengths and greater and then cut to size during the installation of the floor system 10. The beam has a width in a range of 3 to 5 inches and a height in a range of 10 to 20 inches. The sides of the beam 67, from top to bottom, are tapered downwardly and inwardly. This feature allows the beam to be removed easily from it's concrete beam mold after being pre-casted.

Also shown in this drawing are a pair of floor panels 20. The panels include lower ends with notch portions 71 therein. The notch portions 71 are used for aligning the ends of the floor panels on top of the beam 67 and holding the panels 20 in place when building the floor system 10.

Figure 8:
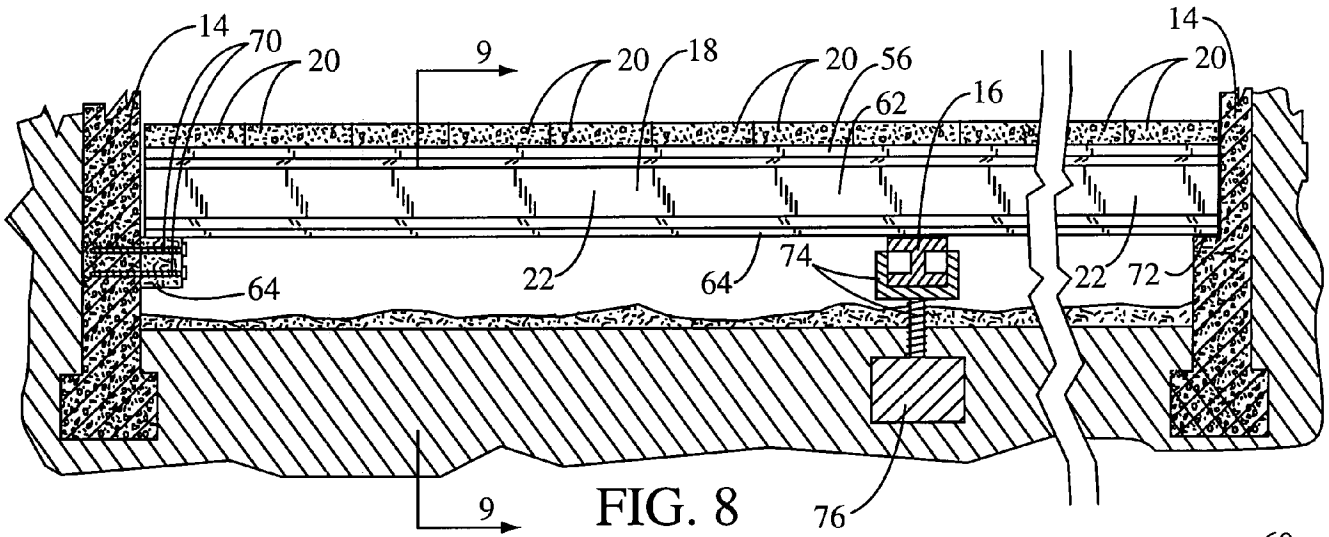
FIG. 8 is a side sectional view of the concrete floor system taken along lines 8—8 shown in FIG. 1.

In FIG. 8, a side sectional view of the concrete floor system 10 is illustrated and taken along lines 8—8 shown in FIG. 1. In this view, the hollow, post-tension beam 22 is shown in the drawing with a plurality of the floor panels 20 resting on the beam 22 and disposed next to each other. While the beam 22 is shown, it should be kept in mind that the other beams 40, 54 and 67 can be used equally well for building the floor system 10.

In this drawing, one end of the beam 22 is shown received on the top of a concrete lintel 68. The lintel 68 is secured to a side of the concrete foundation wall 14 using anchor bolts 70. An opposite end of the beam 22 is shown received on a wall shoulder 72 formed in a top portion of the inside of the foundation wall 14. The wall shoulder 72 and concrete lintel 68 are shown to illustrate two of a number of ways of securing the beam 22 to the side of the foundation wall 14 when using the subject invention.

Also shown in FIG. 8 is an end view of a beam jack assembly 74 mounted on a concrete pad 76. The jack assembly 74 is adjustably mounted on the pad 76 for leveling the foundation beam 16. The foundation beam 16 is shown supporting ends of two of the concrete beams 22. Obviously, the foundation beam 16 and the jack assembly 74 are used when supporting ends of two different lengths of beams 18 as shown in FIG. 1.

Figure 9:
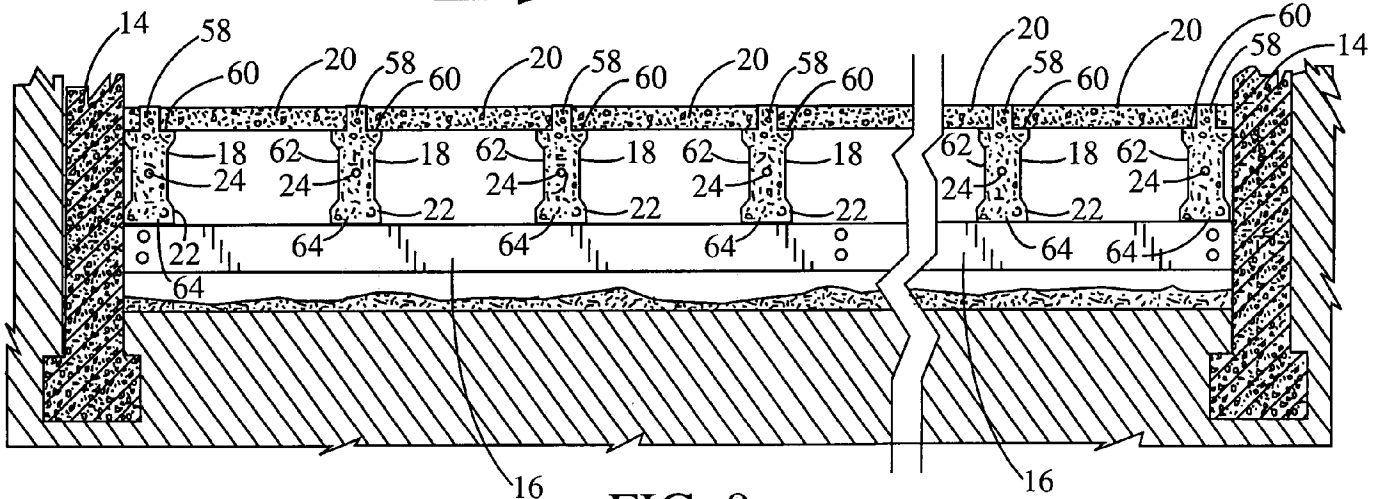
FIG. 9 is another side sectional view of the concrete floor system taken along lines 9—9 shown in FIG. 8.

In FIG. 9, another side sectional view of the concrete floor system 10 is illustrated and taken along lines 9—9 shown in FIG. 8. In this view, opposite ends of the floor panels 20 can be seen resting on the shoulders 60 next to the crown 58 in the top portion 56 of the beam 22. The height of the crown 58 is the same as the thickness of the floor panels 20. Also shown in this drawing is the cable 24 extending through the center portion 62 of the beam 22.

Figure 10:
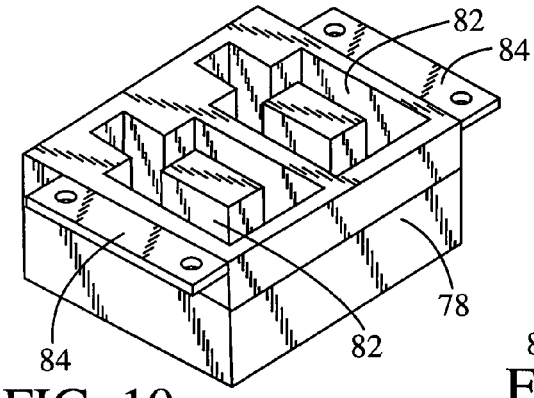
FIG. 10 is a perspective view of a concrete block machine female mold used in a concrete block machine for forming a plurality of hollow concrete blocks.
Figure 11:
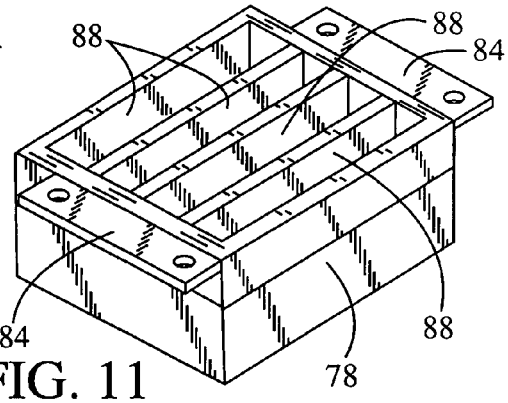
FIG. 11 is a perspective view of another concrete block machine female mold used for forming a plurality of concrete floor panels.

In FIGS. 10 and 11, a perspective view of a concrete block machine female mold 78 is shown for forming the concrete blocks 42 or concrete floor panels 20 therein using a standard concrete block machine. The concrete block machine is shown in FIGS. 11–13 having a general reference numeral 80.

In FIG. 10, the female mold 78 includes two block cavities 82 for receiving a standard zero slump or a light-weight slump concrete for forming a pair of concrete blocks 42 therein. Obviously, any number of blocks 42 can be formed inside the mold 78 depending on the size of the mold and the size of the blocks. The mold 78 includes a pair of hydraulic cylinder attachment plates 84 on opposite sides of the mold. The plates 84 are attached to a pair of moveable hydraulic cylinders 86 used for raising and lowering the mold on the concrete block machine 80. The hydraulic cylinders 86 are shown in FIGS. 11–13.

In FIG. 11, the female mold 78 includes four floor panel cavities 88 for receiving the standard zero slump or the lightweight slump concrete therein for forming the floor panels 20. As mentioned above, any number of floor panels can be formed inside the mold 78 depending on the size of the mold and floor panels.

Figure 12:
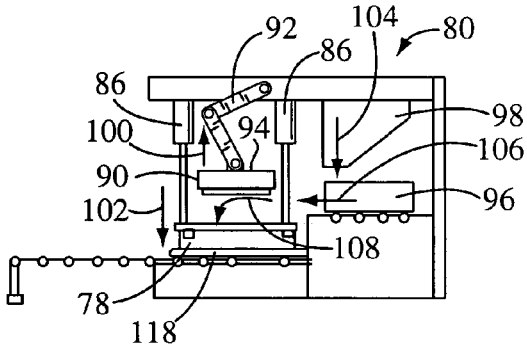
FIG. 12 is a side view of the concrete block machine with attached female mold in a lowered position. A male mold is shown in a raised position above the female mold.
Figure 13:
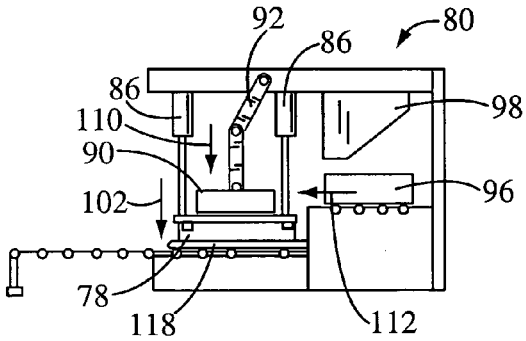
FIG. 13 is a side view of the concrete block machine with the male mold in a lowered position and inserted into an upper portion of the female mold for compressing concrete inside the female mold.

In FIG. 12, a side view of the concrete block machine 80 is shown with the attached concrete block machine female mold 78 in a lowered position and attached to hydraulic cylinders 86. The cylinders 86 are used for raising and lowering the female mold 78. The concrete block machine 80 includes a moveable head 90 with linkage 92 for raising and lowering the head 90. Also, the bottom of the head includes a male mold 94 attached thereto for inserting into a top portion of the female mold 78. Also, the block machine 80 includes a feed drawer 96 disposed under a concrete hopper 98 for receiving the standard zero slump or light weight zero slump concrete and feeding it into the top of the female mold 78.

In this drawing, the linkage 92 has moved the head 90 in a raised position, as indicated by arrow 100 and the female mold 78 is in a lower position, as indicated by arrow 102. The hopper 908 is shown feeding the concrete into the feed drawer 96, as indicated by arrow 104. When the feed drawer 96 has been filled, it is moved above the female mold 78, as indicated by arrow 106. At this time, the concrete drops into and fills the block cavities 82, in this example, as indicated by arrow 108.

In FIG. 13, another side view of the concrete block machine 80 is shown with the moveable head 90 in a lowered position, as indicated by arrow 110. The male mold 94 is inserted into an upper portion of the block cavities 82 of the female mold 78. The head 90 now compresses and vibrates the concrete in the female mold. The feed drawer 96 is shown moved back and positioned under the concrete hopper 98, as indicated by arrow 112.

Figure 14:
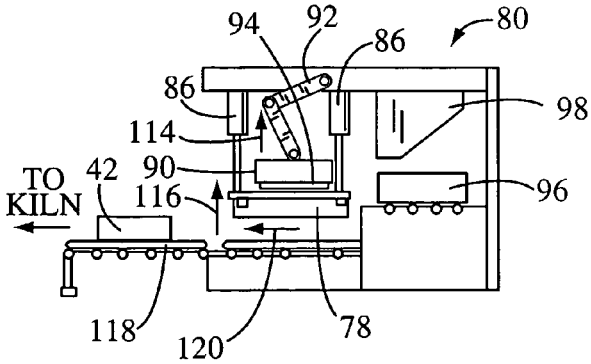
FIG. 14 is a side view of the concrete block machine with the male and female molds in a raised position and a completed hollow concrete block placed on a conveyor pallet ready to be sent to a kiln for heating and curing.

In FIG. 14, still another side view of the block machine 80 is shown. In this drawing, the making of the concrete blocks 42 is completed and the moveable head 90 is shown in a raised position, as indicated by arrow 114. Also, the female mold 78 is shown in a raised position, as indicated by arrow 116. The completed blocks 42 are shown on a conveyor pallet 118 moved to the left, as indicated by arrow 120, and away from the concrete block machine 80. The concrete blocks 42 are now ready to be sent to a kiln for heating and curing of the concrete before being sent to a job site.

While the making of the concrete blocks 42 is shown in FIGS. 12–14, the concrete floor panels 20 using the female mold 78 are made in the same manner using the concrete block machine 80. Also, it should be mentioned that any number of different types of concrete floor system components, depending on their size, can be made equally well in the concrete block machine 80.

The embodiments of the invention for which as exclusive privilege and property right is claimed are defined as follows:

1. A concrete floor system used for attachment to an inside of foundation walls of a building structure and receipt on one or more foundation beams, the concrete floor system provides for expansion and contraction of soils below the concrete floor and ease in removing and replacing components used in the concrete floor, the floor system comprising:

a plurality of parallel hollow post-tension concrete tension beams, opposite ends of said beams adapted for mounting next to the inside of the foundation walls, said beams having a tension cable received therethrough, opposite ends of said tension cable held on end plates, said end plates received inside recessed ends of each of said beams; and a plurality of angular shaped floor panels, said floor panels disposed next to each other with opposite sides of said panels engaging a top portion of parallel adjacent beams and resting thereon in an interlocking manner, said beams having a top portion with a crown, said crown having shoulders disposed on opposite sides thereof, said shoulders receiving opposite sides of said floor panels thereon.

2. The floor system as described in claim 1 wherein said beams are made of hollow concrete blocks disposed next to each other and compressed together by a tension cable received therethrough, opposite ends of said tension cable held on end plates, said end plates received inside recessed ends of a pair of end blocks.

3. The floor system as described in claim 2 further including a center block disposed along a center of a length of said hollow concrete blocks, said center block having a cable opening for receiving a portion of said tension cable therethrough and suspending said tension cable inside said hollow concrete blocks.

4. The floor system as described in claim 1 wherein said crown in the top portion of said beams has a height equal to a thickness of said floor panels.

5. The floor system as described in claim 1 wherein said beams have a top portion having a crown with shoulders disposed on opposite sides of said crown, a center portion with an opening for receiving a portion of said tension cable therethrough and a lower portion, the lower portion acting as a beam base adapted for receipt on a foundation beam.

6. A method of making a concrete floor component used in a concrete floor system and using a concrete block machine, the block machine having a moveable head, a concrete feed drawer and a female floor component mold, the steps comprising:

pouring concrete from the concrete feed drawer into a mold cavity of the female floor component mold;

engaging the top of the female floor component mold with the movable head;

compressing and vibrating the concrete in the mold cavity of the female floor component mold using the movable head; and removing the female floor component mold from the completed floor component.

7. The method as described in claim 6 further including the step of drying and curing the completed floor component in a kiln.

8. The method as described in claim 6 wherein the mold cavity is in the form of a hollow concrete block for forming at least one hollow concrete block for use in forming a hollow concrete beam used in the concrete floor system.

9. The method as described in claim 6 wherein the mold cavity is in the form of a floor panel for forming at least one floor panel used in the concrete floor system.

10. The method as described in claim 9 wherein the floor panel is formed with a notch portion in the lower ends of opposite sides thereof, the notch portions adapted for receipt on top of a pre-cast beam used in the concrete floor system.

11. A concrete floor system used for attachment to an inside of foundation walls of a building structure, the concrete floor system provides for expansion and contraction due to expansive soils if the system is poured on grade and provides for ease in removing and replacing components used in the concrete floor, the floor system comprising:

a plurality of parallel solid pre-cast, pretension concrete beams, opposite ends of said beams adapted for mounting next to the inside of the foundation walls, said beams having a tension cable received therethrough, opposite ends of said tension cable held on end plates, said end plates received inside recessed ends of each of said beams; and a plurality of angular shaped floor panels, said floor panels disposed next to each other with opposite sides of said panels engaging a top portion of said parallel adjacent concrete beams and resting thereon in an interlocking manner, said floor panels including notched portions, said notched portions in a lower end of opposite sides of said floor panels, said notched portions for receipt on top of said concrete beams.

12. The floor system as described in claim 11 wherein said pre-cast, pre-tension concrete beams are from top to bottom tapered downwardly and inwardly and adapted for ease in removal from a concrete beam mold.

* * * * *